US006421587B2

(12) United States Patent
Diana et al.

(10) Patent No.: US 6,421,587 B2
(45) Date of Patent: Jul. 16, 2002

(54) METHODS AND APPARATUS FOR LOCOMOTIVE CONSIST DETERMINATION

(75) Inventors: David L. Diana; John R. Doner, both of Melbourne, FL (US)

(73) Assignee: GE Harris Railway Electronics, LLC, Melbourne, FL (US)

( * ) Notice: Subject to any disclaimer, the term of this patent is extended or adjusted under 35 U.S.C. 154(b) by 0 days.

(21) Appl. No.: 09/750,381

(22) Filed: Dec. 28, 2000

Related U.S. Application Data

(60) Provisional application No. 60/173,972, filed on Dec. 30, 1999.

(51) Int. Cl.[7] ..... B61L 25/02

(52) U.S. Cl. ..... 701/19; 701/117; 246/122 R

(58) Field of Search ..... 701/19, 117; 342/357.07; 340/988; 246/122 R

(56) References Cited

U.S. PATENT DOCUMENTS

| | | | | |
|---|---|---|---|---|
| 4,602,335 A | | 7/1986 | Perlmutter | |
| 5,129,605 A | | 7/1992 | Burns et al. | |
| 5,570,284 A | | 10/1996 | Roselli et al. | |
| 5,574,469 A | | 11/1996 | Hsu | |
| 5,621,417 A | * | 4/1997 | Hassan | 342/457 |
| 5,682,139 A | * | 10/1997 | Pradeep et al. | 340/539 |
| 5,691,980 A | | 11/1997 | Welles, II et al. | |
| 5,740,547 A | | 4/1998 | Kull et al. | |
| 5,752,218 A | | 5/1998 | Harrison et al. | |
| 5,757,291 A | * | 5/1998 | Kull | 340/988 |
| 5,828,979 A | | 10/1998 | Polivka et al. | |
| 5,902,341 A | * | 5/1999 | Wilson | 701/19 |
| 5,969,643 A | | 10/1999 | Curtis | |
| 5,986,577 A | * | 11/1999 | Bezos | 340/933 |
| 6,029,103 A | * | 2/2000 | Faubel et al. | 701/19 |
| 6,263,265 B1 | * | 7/2001 | Fera | 701/19 |

FOREIGN PATENT DOCUMENTS

| | | |
|---|---|---|
| DE | 19647461 | 5/1998 |
| EP | 0708427 | 4/1996 |
| EP | 0747726 | 12/1996 |
| EP | 0791518 | 8/1997 |

* cited by examiner

*Primary Examiner*—Michael J. Zanelli
*Assistant Examiner*—Eric M Gibson
(74) *Attorney, Agent, or Firm*—Carl A. Rowold; Armstrong Teasdale LLP

(57) ABSTRACT

A method for identifying locomotive consists within train consists determines an order and orientation of the locomotives within the identified locomotive consists. An on-board tracking system is mounted to each locomotive and includes locomotive interfaces for interfacing with other systems of the particular locomotive, a computer for receiving inputs from the interface, a GPS receiver, and a satellite communicator (transceiver). As locomotives provide location and discrete information from the field, a central data processing facility receives the raw locomotive data. The data center processes the locomotive data and determines locomotive consists.

56 Claims, 6 Drawing Sheets

METHODS AND APPARATUS FOR LOCOMOTIVE CONSIST DETERMINATION

CROSS REFERENCE TO RELATED APPLICATIONS

This application claims the benefit of U.S. Provisional Application No. 60/173,972, filed Dec. 30, 1999, which is hereby incorporated by reference in its entirety.

BACKGROUND OF THE INVENTION

This invention relates generally to locomotive management, and more specifically, to tracking locomotives and determining the order and orientation of specific locomotives in a locomotive consist For extended periods of time, e.g., 24 hours or more, locomotives of a locomotive fleet of a railroad are not necessarily accounted for. This delay is due, at least in part to the many different locations in which the locomotives may be located and the availability of tracking device at those locations. In addition, some railroads rely on wayside automatic equipment identification (AEI) devices to provide position and orientation of a locomotive fleet. AEI devices typically are located around major yards and provide minimal position data. AEI devices are expensive and the maintenance costs associated with the existing devices are high. Therefore, there exists a need for cost-effective tracking of locomotives.

BRIEF SUMMARY OF THE INVENTION

In one aspect, the present invention relates to identifying locomotive consists within train consists, and determining the order and orientation of the locomotives within the identified locomotive consists. By identifying locomotive consists and the order and orientation of locomotives within such consists, a railroad can better manage a locomotive fleet.

In one exemplary embodiment, an on-board tracking system is mounted to each locomotive of a train and includes locomotive interfaces for interfacing with other systems of the particular locomotive, a computer coupled to receive inputs from the interfaces, and a GPS receiver and a satellite communicator (transceiver) coupled to the computer. A radome is mounted on the roof of the locomotive and houses the satellite transmit/receive antennas coupled to the satellite communicator and an active GPS antenna coupled to the GPS receiver.

Generally, the onboard tracking system determines the absolute position of the locomotive on which it is mounted and additionally, obtains information regarding specific locomotive interfaces that relate to the operational state of the locomotive. Each equipped locomotive operating in the field determines its absolute position and obtains other information independently of other equipped locomotives. Position is represented as a geodetic position, i.e., latitude and longitude.

The locomotive interface data is typically referred to as "locomotive discretes" and includes key pieces of information utilized during the determination of locomotive consists. In an exemplary embodiment, three (3) locomotive discretes are collected from each locomotive. These discretes are reverser handle position, trainlines eight (8) and nine (9), and online/isolate switch position. Reverser handle position is reported as "centered" or "forward/reverse". A locomotive reporting a centered reverser handle is in "neutral" and is either idle or in a locomotive consist as a trailing unit. A locomotive that reports a forward/reverse position is "in-gear" and most likely either a lead locomotive in a locomotive consist or a locomotive consist of one locomotive. Trainlines eight (8) and nine (9) reflect the direction of travel with respect to short-hood forward versus long-hood forward for locomotives that have their reverser handle in a forward or reverse position.

The online/isolate switch discrete indicates the consist "mode" of a locomotive during railroad operations. The online switch position is selected for lead locomotives and trailing locomotives that will be controlled by the lead locomotive. Trailing locomotives that will not be contributing power to the locomotive consist will have their online/isolate switch set to the isolate position.

The locomotives provide location and discrete information from the field, and a data center receives the raw locomotive data. The data center processes the locomotive data and determines locomotive consists.

Specifically, and in one embodiment, the determination of locomotive consists is a three (3) step process in which 1) the locomotives in the consist are identified, 2) the order of the locomotives with respect to the lead locomotive are identified, and 3) the orientation of the locomotives in the consist are determined as to short-hood forward versus long hood forward.

DETAILED DESCRIPTION OF THE INVENTION

As used herein, the term "locomotive consist" means one or more locomotives physically connected together, with one locomotive designated as a lead locomotive and the other locomotives designated as trailing locomotives. A "train consist" means a combination of cars (freight, passenger, bulk) and at least one locomotive consist. Typically, a train consist is built in a terminal/yard and the locomotive consist is located at the head-end of the train. Occasionally, trains require additional locomotive consists within the train consist or attached to the last car in the train consist. Additional locomotive consists sometimes are required to improve train handling and/or to improve train consist performance due to the terrain (mountains, track curvature) in which the train will be travelling. A locomotive consist at a head-end of a train may or may not control locomotive consists within the train consist.

A locomotive consist is further defined by the order of the locomotives in the locomotive consist, i.e. lead locomotive, first trailing locomotive, second trailing locomotive, and the orientation of the locomotives with respect to short-hood forward versus long-hood forward. Short-hood forward refers to the orientation of the locomotive cab and the direction of travel. Most North American railroads typically require the lead locomotive to be oriented short-hood forward for safety reasons, as forward visibility of the locomotive operating crew is improved.

Figure 1:
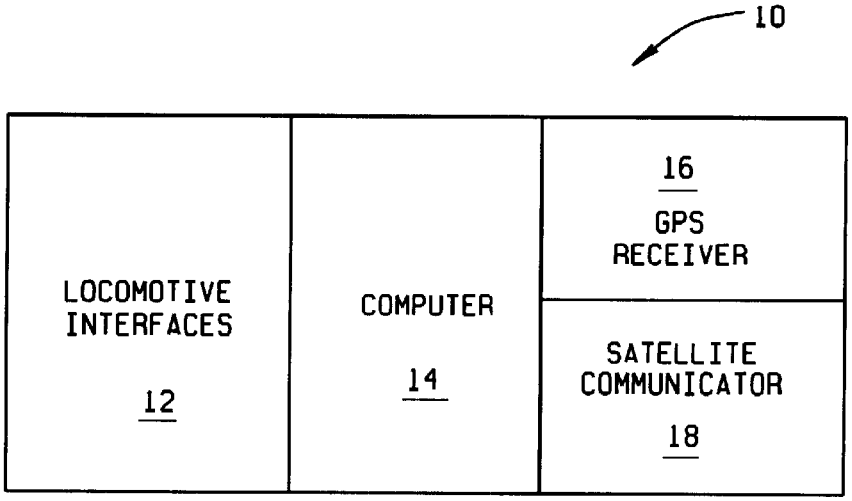
FIG. 1 is a block diagram of an on-board tracking system.

FIG. 1 is a block diagram of an on-board tracking system 10 for each locomotive and/or car of a train consist. Although the on-board system is sometimes described herein in the context of a locomotive, it should be understood that the tracking system can be used in connection with cars as well as any other train consist member. More specifically, the present invention may be utilized in the management of locomotives, rail cars, any maintenance of way (vehicle), as well as other types of transportation vehicles, e.g., trucks, trailers, baggage cars. Also, and as explained below, each locomotive and car of a particular train consist may not necessarily have such on-board tracking system.

As shown in FIG. 1, system 10 includes locomotive interfaces 12 for interfacing with other systems of the particular locomotive on which on-board system 10 is mounted, and a computer 14 coupled to receive inputs from interface 12. System 10 also includes a GPS receiver 16 and a satellite communicator (transceiver) 18 coupled to computer 14. Of course, system 10 also includes a power supply for supplying power to components of system 10. A radome (not shown) is mounted on the roof of the locomotive and houses the satellite transmit/receive antennas coupled to satellite communicator 18 and an active GPS antenna coupled to GPS receiver 16.

Figure 2:
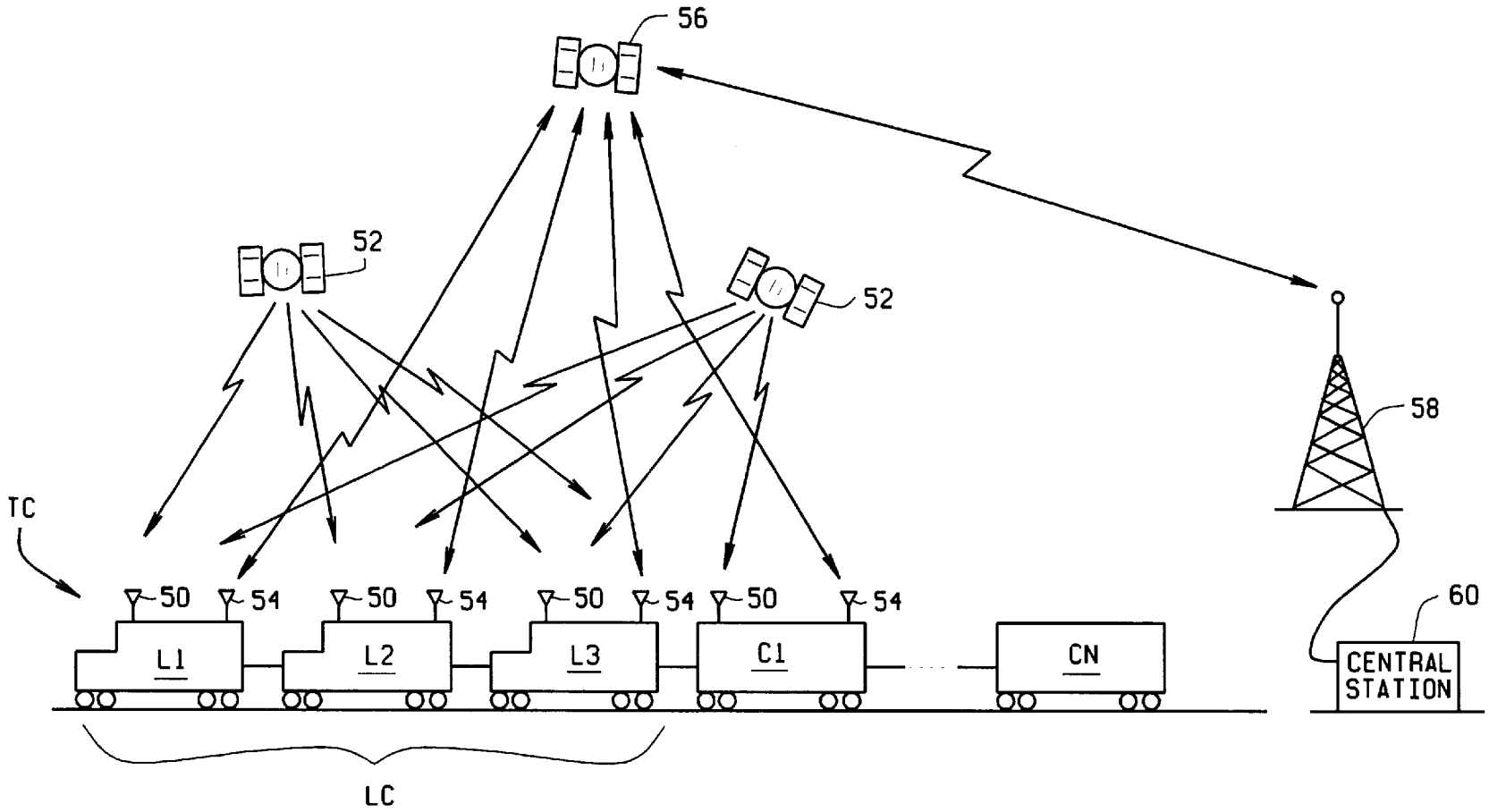
FIG. 2 illustrates a train consist including a system in accordance with one embodiment of the present invention.

FIG. 2 illustrates a locomotive consist LC which forms part of a train consist TC including multiple cars C1–CN. Each locomotive L1–L3 and car C1 includes a GPS receiver antenna 50 for receiving GPS positioning data from GPS satellites 52. Each locomotive L1–L3 and car C1 also includes a satellite transceiver 54 for exchanging, transmitting and receiving data messages with central station 60.

Generally, each onboard tracking system 10 determines the absolute position of the locomotive on which it is mounted and additionally, obtains information regarding specific locomotive interfaces that relate to the operational state of the locomotive. Each equipped locomotive operating in the field determines its absolute position and obtains other information independently of other equipped locomotives. Position is represented as a geodetic position, i.e., latitude and longitude.

The locomotive interface data is typically referred to as "locomotive discretes" and are key pieces of information utilized during the determination of locomotive consists. In an exemplary embodiment, three (3) locomotive discretes are collected from each locomotive. These discretes are reverser handle position, trainlines eight (8) and nine (9), and online/isolate switch position. Reverser handle position is reported as "centered" or "forward/reverse". A locomotive reporting a centered reverser handle is in "neutral" and is either idle or in a locomotive consist as a trailing unit. A locomotive that reports a forward/reverse position refers to a locomotive that is "in-gear" and most likely either a lead locomotive in a locomotive consist or a locomotive consist of one locomotive. Trainlines eight (8) and nine (9) reflect the direction of travel with respect to short-hood forward versus long-hood forward for locomotives that have their reverser handle in a forward or reverse position.

Trailing locomotives in a locomotive consist report the appropriate trainline information as propagated from the lead locomotive. Therefore, trailing locomotives in a locomotive consist report trainline information while moving and report no trainline information while idle (not moving).

The online/isolate switch discrete indicates the consist "mode" of a locomotive during railroad operations. The online switch position is selected for lead locomotives and trailing locomotives that contribute power and are controlled by the lead locomotive. Trailing locomotives that are not contributing power to the locomotive consist have their online/isolate switch set to the isolate position.

As locomotives provide location and discrete information from the field, a central data processing center, e.g., central station 60, receives the raw locomotive data. Data center 60 processes the locomotive data and determines locomotive consists as described below.

Generally, each tracking system 10 polls at least one GPS satellite 52 at a specified send and sample time. In one embodiment, a pre-defined satellite 52 is designated in memory of system 10 to determine absolute position. A data message containing the position and discrete data is then transmitted to central station 60 via satellite 56, i.e., a data satellite, utilizing transceiver 54. Typically, data satellite 56 is a different satellite than GPS satellite 52. Additionally, data is transmitted from central station 60 to each locomotive tracking system 10 via data satellite 56. Central station 60 includes at least one antenna 58, at least one processor (not shown), and at least one satellite transceiver (not shown) for exchanging data messages with tracking systems 10.

More specifically, and in one embodiment, the determination of each locomotive consist is a three (3) step process in which 1) the locomotives in the consist are identified, 2) the order of the locomotives with respect to the lead locomotive are identified, and 3) the orientation of the locomotives in the consist are determined as to short-hood versus long hood forward. In order to identify locomotives in a locomotive consist, accurate position data for each locomotive in the locomotive consist is necessary. Due to errors introduced into the solution provided by GPS, typical accuracy is around 100 meters. Randomly collecting location data therefore will not provide the required location accuracy necessary to determine a locomotive consist.

In one embodiment, the accuracy of the position data relative to a group of locomotives is improved by sampling (collecting) the position data from each GPS receiver of each locomotive in the consist simultaneously-at the same time. The simultaneous sampling of location data is kept in synchronization with the use of on board clocks and the GPS clock. The simultaneous sampling between multiple assets is not exclusive to GPS, and can be utilized in connection with other location devices such as Loran or Qualcomm's location device (satellite triangulation).

The simultaneous sampling of asset positions allows for the reduction of atmospheric noise and reduction in the U.S. government injected selective availability error (noise/injection cancellation). The reduction in error is great enough to be assured that assets can be uniquely identified. This methodology allows for consist order determination while the consist is moving and differs greatly from a time averaging approach which requires the asset to have been stationary, typically for many hours, to improve GPS accuracy.

More specifically, civil users worldwide use the GPS without charge or restrictions. The GPS accuracy is intentionally degraded by the U.S. Department of Defense by the use of selective availability (SA). As a result, the GPS predictable accuracy is as follows.

100 meter horizontal accuracy, and 156 meter vertical accuracy.

Noise errors are the combined effect of PRN code noise (around 1 meter) and noise within the receiver (around 1 meter). Bias errors result from selective availability and other factors. Again, selective availability (SA) is a deliberate error introduced to degrade system performance for non-U.S. military and government users. The system clocks and ephemeris data is degraded, adding uncertainty to the pseudo-range estimates. Since the SA bias, specific for each satellite, has low frequency terms in excess of a few hours, averaging pseudo-range estimates over short periods of time is not effective. The potential accuracy of 30 meters for C/A code receivers is reduced to 100 meters.

As a result of the locomotives being very close geographically and sampling the satellites at exactly the same time, a majority of the errors are identical and are cancelled out resulting in an accuracy of approximately 25 feet. This improved accuracy does not require additional processing nor more expensive receivers or correction schemes.

Each locomotive transmits a status message containing a location report that is time indexed to a specific sample and send time based on the known geographic point from which the locomotive originated. A locomotive originates from a location after a period in which it has not physically moved (idle). Locomotive consists are typically established in a yard/terminal after an extended idle state. Although not necessary, in order to obtain a most accurate location, a locomotive should be moving or qualified over a distance, i.e., multiple samples when moving over some minimum distance. Again, however, it is not necessary that the locomotive be moving or qualified over a distance.

Each tracking system 10 maintains a list of points known as a locomotive assignment point (LAP) which correlates to the yards/terminals in which trains are built. As a locomotive consist assigned to a train consist departs from a yard/terminal a locomotive assignment point (LAP) determines the departure condition and sends a locomotive position message back to data center 60. This message contains at a minimum, latitude, longitude and locomotive discretes.

The data for each locomotive is sampled at a same time based on a table maintained by each locomotive and data center 60, which contains LAP ID, GPS sample time, and message transmission time. Therefore, data center 60 receives a locomotive consist message for each locomotive departing the LAP, which in most instances provides the first level of filtering for potential consist candidates. The distance at which the locomotives determine LAP departure is a configurable item maintained on-board each tracking system.

Figure 3:
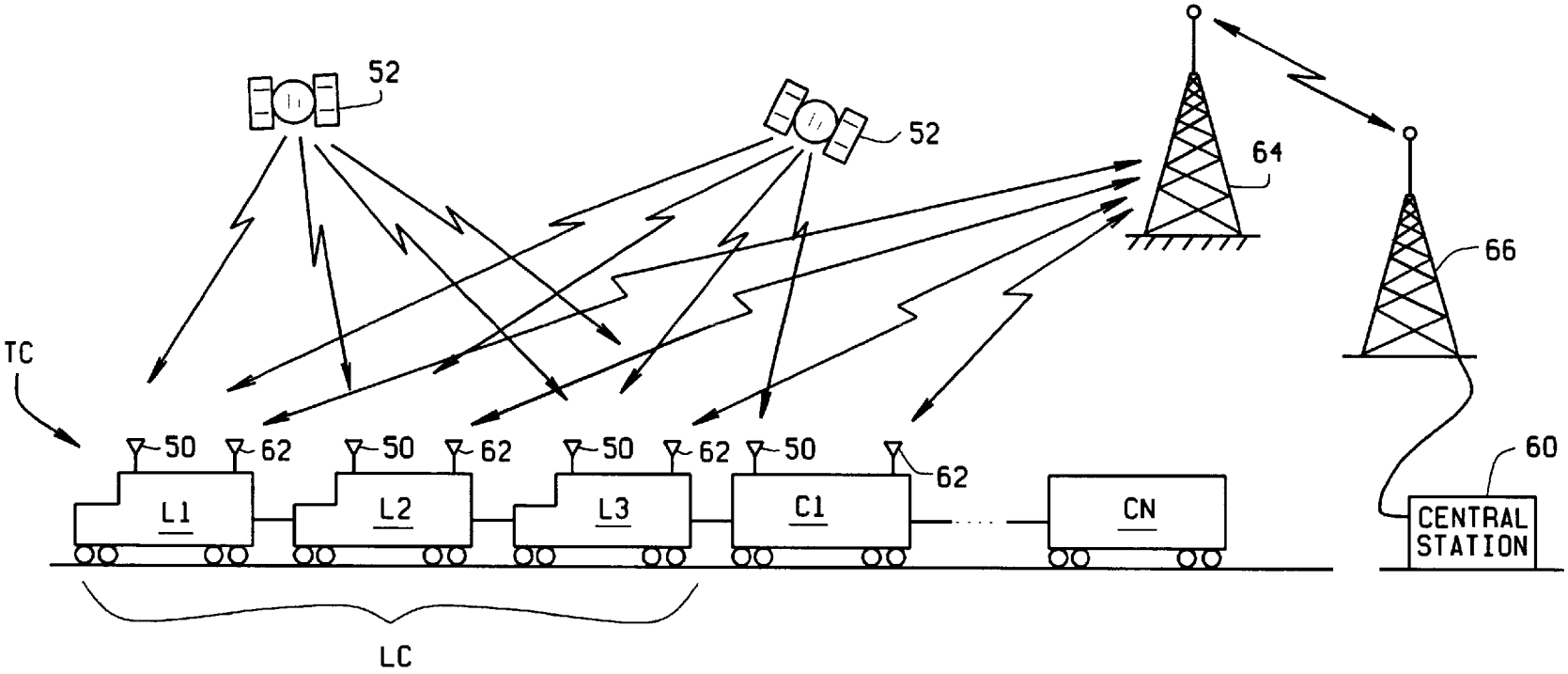
FIG. 3 illustrates a train consist including a system in accordance with another embodiment of the present invention.

FIG. 3 illustrates another embodiment of train consist TC including on-board tracking system 10. Components in FIG. 3 identical to components in FIG. 2 are identified in FIG. 3 using the same reference numerals as used in FIG. 2. Each locomotive L1–L3 and car C1 includes a GPS receiver antenna 50 for receiving GPS positioning data from GPS satellites 52. Each locomotive L1–L3 and car C1 also includes a radio transceiver 62 for exchanging, transmitting and receiving data messages with central station 60 via antennas 64 and 66. The on-board systems utilized in the configuration illustrated in FIG. 3 configuration are identical to on-board system 10 illustrated in FIG. 1 except that rather than a satellite communication 18, the system illustrated in FIG. 3 includes a radio communicator.

Generally, and as with system 10, each tracking system 10 polls at least one GPS satellite 52 at a specified send and sample time. In one embodiment, a pre-defined satellite 52 is designated in memory to determine absolute position. A data message containing the position and discrete data is then transmitted to central station 60 via antenna 64 utilizing transceiver 62. Additionally, data is transmitted from central station 60 to each locomotive tracking system via antenna 64. Central station 60 includes at least one antenna 66, at least one processor (not shown), and at least one satellite transceiver (not shown) for exchanging data messages with the tracking systems.

In another embodiment, each on-board system includes both a satellite communicator (FIG. 1) and a radio communicator (FIG. 3). The radio communicators are utilized so that each on-board system can exchange data with other on-board systems of the train consist. For example, rather than each locomotive separately communicating its data with central station 60 via the data satellite, the data can be accumulated by one of the on-board systems via radio communications with the other on-board systems. One transmission of all the data to the central station from a particular train consist can then be made from the on-board system that accumulates all the data. This arrangement provides the advantage of reducing the number of transmissions and therefore, reducing the operational cost of the system.

Data center 60 may also include, in yet another embodiment, a web server for enabling access to data at center 60 via the Internet. Of course, the Internet is just one example of a wide area network that could be used, and other wide area networks as well as local area networks could be utilized. The type of data that a railroad may desire to post at a secure site accessible via the Internet includes, by way of example, locomotive identification, locomotive class (size of locomotive), tracking system number, idle time, location (city and state), fuel, milepost, and time and date transmitted. In addition, the data may be used to geographically display location of a locomotive on a map. Providing such data on a secure site accessible via the Internet enables railroad personnel to access such data at locations remote from data center 60 and without having to rely on access to specific personnel.

Figure 4:
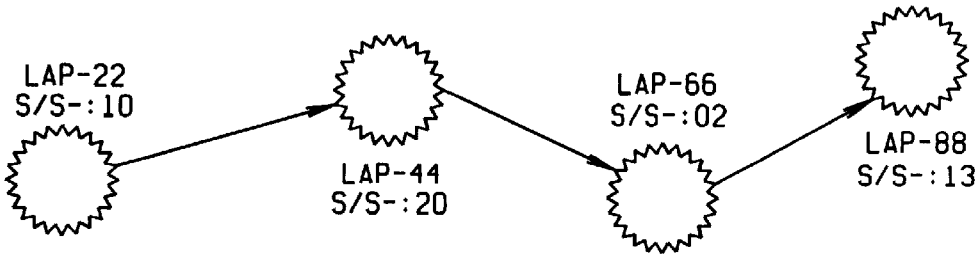
FIG. 4 illustrates a sample and send method.

FIG. 4 illustrates the above described sample and send method. For example, at LAP-22, three locomotives are idle and at some point, are applied to a train ready for departure. As the train departs the yard, each on-board system 10 for each locomotive determines that it is no longer idle and that it is departing the LAP-22 point. Once LAP departure has been established, on-board tracking system 10 changes its current sample and send time to the sample and send time associated with LAP-22 as maintained onboard all tracking equipped locomotives. Based on the information in the example, the three (3) locomotives begin sampling and sending data at ten (10) minutes after each hour.

The locomotives run-thru LAP 44 (no idle). The three locomotives therefore continue through LAP-44 on the run-thru tracks without stopping the train. The on-board systems determine entry and exit of the proximity point, but the sample and send time would remain associated with the originating LAP point (22).

The three (3) locomotives then enter LAP-66 and a proximity event would be identified. The train is scheduled to perform work in the yard which is anticipated to require nine (9) hours. During this time, the three (3) locomotives remain attached to the consist while the work is performed. After completing the assigned work, the train departs the yard (LAP-66) destined for the terminating yard (LAP-88). At this point, each on-board system determines it is no longer idle and switches its sample and send time to that specified in their table for LAP-66, i.e., at 2 minutes after each hour. At this point, the three (3) locomotives have departed LAP-66 and their sample and send time is now two (2) minutes after each hour.

At some point, the three (3) locomotives enter LAP-88 (proximity alert) and become idle for an extended period. The locomotives continue to sample and send signals based on their last origin location, which was LAP-66.

As locomotive position reports are received by data center 60, the sample time associated with the reports is utilized to sort the locomotives based on geographic proximity. All locomotives that have departed specific locations will sample and send their position reports based on a lookup table maintained onboard each locomotive. Data center 60 sorts the locomotive reports and determines localized groups of locomotives based on sample and send time.

A first step in the determination of a locomotive consist requires identification of candidate consists and lead locomotives. A lead locomotive is identified by the reverser handle discrete indicating the handle is in either the forward or reverse position. Also, the lead locomotive reports its orientation as short-hood forward as indicated by trainline discretes. Otherwise, the locomotive consist determination terminates pursuing a particular candidate locomotive consist due to the improper orientation of the lead locomotive. If a lead locomotive is identified (reverser and orientation) and all of the other locomotives in the candidate consist reported their reverser handle in the centered (neutral) position indicating trailing locomotives, the next step in the consist determination process is executed.

At this point, candidate locomotive consists have been identified based on their sample and send time and all lead locomotives have been identified based on reverser handle discretes. The next step is to associate trailing locomotives with a single lead locomotive based on geographic proximity. This is accomplished by constructing and computing the centroid of a line between each reporting locomotive and each lead locomotive. The resulting data is then filtered and those trailing locomotives with centroids that fall within a specified distance of a lead locomotive are associated with the lead as a consist member. This process continues until each reporting locomotive is either associated with a lead locomotive or is reprocessed at the next reporting cycle.

Then, the order of the locomotives in the locomotive consist is determined.

The lead locomotive was previously identified, which leaves the identification of the trailing units. It should be noted that not all locomotives are equipped with on-board tracking systems and therefore, "ghost" locomotives, i.e., locomotives that are not equipped with tracking systems will not be identified at this point in time. It should also be noted that in order to identify ghost locomotives, the ghost locomotives must be positioned between tracking equipped locomotives.

Figure 5:
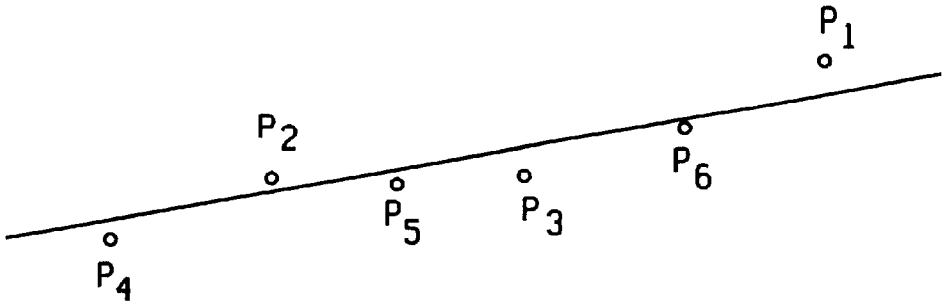
FIG. 5 illustrates apparent positions of six candidate locomotives for a locomotive consist.

FIG. 5 depicts six points in a plane which are defined by returned positional data from six locomotives in a power consist of a train. The points $P_1, \ldots, P_6$ represent the respective location of each locomotive, and since GPS positional data is not perfect, the reference line shown is taken to be the line best fitting the points (approximating the actual position of the track).

Figure 6:
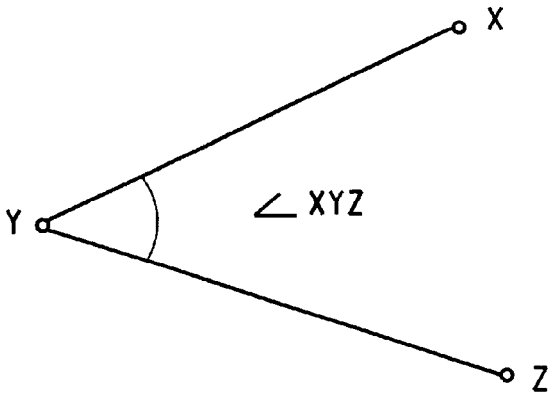
FIG. 6 illustrates an angle defined by three points.

With the notation denoting the unsigned magnitude of an angle defined on points X, Y, and Z, with Y as the vertex, as shown in FIG. 6, the angles defined by the positions of locomotives are used in order to establish their order in the locomotive consist.

Figure 7:
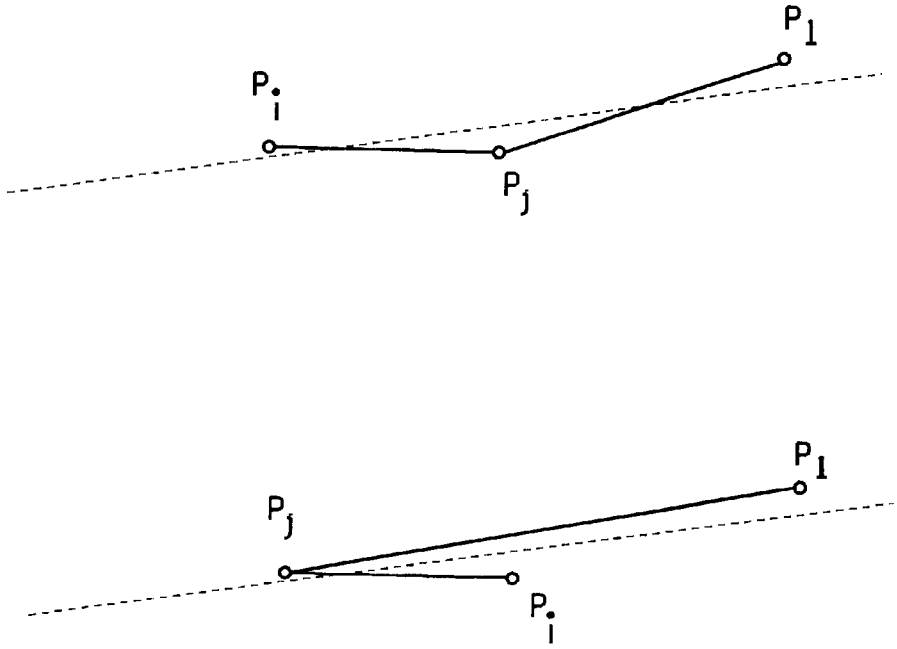
FIG. 7 illustrates using angular measure to determine locomotive order.

Referring to FIG. 7, data collection of locomotive discretes onboard the locomotive allows the determination of the position of the lead locomotive by information other than its position in the consist. Therefore, it is known that all other locomotives are behind the lead locomotive. Since the lead locomotive is identified, it is assigned the point $P_1$. For the remaining points, there is no specific knowledge of their order in the power consist, other than that they follow $P_1$. The following relationships exist.

$$\angle P_iP_jP_1 \approx 180° \rightarrow P_i \text{ follows } P_j,$$

and $$\angle P_iP_jP_1 \approx 0° \rightarrow P_1 \text{ precedes } P_j.$$

By forming a matrix with all rows and columns indexed by the locomotives known to be in the consist, and initially setting all entries of the matrix to zero, then a 1 is placed in any cell such that the row entry (locomotive) of the cell occurs earlier in the consist than the column entry, as determined by the angular criterion given above. Since the lead locomotive is already known, a 1 is placed in each cell of row 1 of the matrix, except the cell corresponding to (1,1). This leads to (N−1)(N−2)/2 comparisons, where N locomotives are in the consist, since pair $(P_i, P_j)$ $i \neq j$ must be tested only once, and $P_1$ need not be included in the testing.

The matrix is shown below.

$$M = \begin{array}{c} P_1 \\ P_2 \\ P_3 \\ P_4 \\ P_5 \\ P_6 \end{array} \begin{bmatrix} 0 & 1 & 1 & 1 & 1 & 1 \\ 0 & 0 & 0 & 1 & 0 & 0 \\ 0 & 1 & 0 & 1 & 1 & 0 \\ 0 & 0 & 0 & 0 & 0 & 0 \\ 0 & 1 & 0 & 1 & 0 & 0 \\ 0 & 1 & 1 & 1 & 1 & 0 \end{bmatrix}$$

The order of the locomotives in the consist corresponds to the number of ones in each row. That is, the row with the most ones is the lead locomotive, and the locomotives then occur in the consist as follows:

$P_1$-five 1's lead locomotive, $P_6$-four 1's, next in consist, $P_3$-three 1's next in consist, $P_5$-two 1's next in consist, $P_2$-one 1 next in consist, $P_4$- zero 1's last in consist.

The above described method does not require that all locomotives be in a single group in the train. If a train is on curved track, the angles would vary more from 0° and 180° than would be the case on straight track. However, it is extremely unlikely that a train would ever be on a track of such extreme curvature that the angular test would fail.

Another possible source of error is the error implicit in GPS positional data. However, all of the locomotives report GPS position as measured at the same times, and within a very small distance of each other. Thus, the errors in position are not expected to influence the accuracy of the angular test by more than a few degrees, which would not lead to confusion between 0° and 180°.

Figure 8:
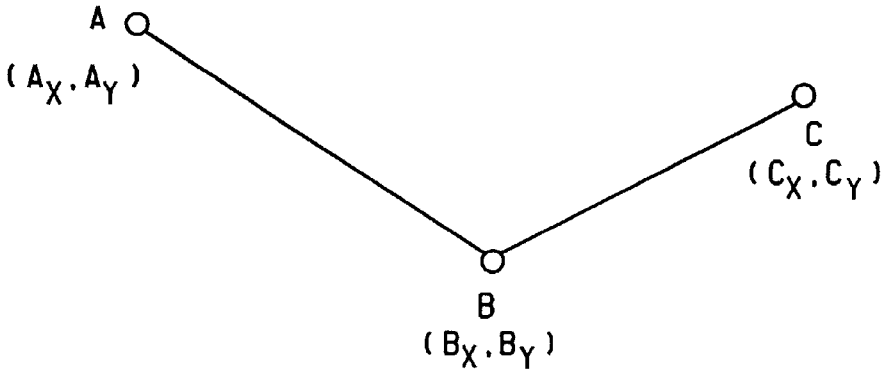
FIG. 8 illustrates coordinates of points forming an angle.

The determination of angle as described above need not actually be completely carried out. In particular, the dot product of two vectors permits quick determination of whether the angle between them is closer to 0° or 180°. FIG. 8 illustrates three points defining an angle, with coordinates determined as though the points were in a Cartesian plane. Given these points and the angle indicated, the dot product may be expressed by the simple computation:

$$s=(A_x-B_x)(C_x-B_x)+(A_y-B_y)(C_y-B_y).$$

The geometric interpretation of the dot product is given by:

$$s=\|AB\|\cdot\|BC\|\cdot cos(\angle ABC),$$

where the notation ||XY|| denotes the length of a line segment between points X and Y. The lengths of line segments are always positive, so that the sign of s is determined soley by the factor cos(∠ABC), and that factor is positive for all angles within 90° of 0°, and is negative for all angles within 90° of 180°. Therefore, a test for the relative order of two locomotives can be executed by using the absolute positions of the locomotives and computing dot products for the angles shown in FIG. 6. The sign of the dot product then suffices to specify locomotive order.

Locomotive positions have been interpreted as Cartesian coordinates in a plane, while GPS positions are given in latitude, longitude, and altitude. Using the fact that a minute of arc on a longitudinal circle is approximately 1 nautical mile, and that a minute of arc on a latitudinal circle is approximately 1 nautical mile multiplied by the cosine of the latitude, one obtains an easy conversion of the (latitude, longitude) pair to a Cartesian system. Given a latitude and longitude of a point, expressed as(θ,ϕ), conversion to Cartesian coordinates is given by:

$$x=60\cdot\theta\cdot\cos(\theta),$$

$$y=60\cdot\phi.$$

This ignores the slight variations in altitude, and in effect distorts the earth's surface in a small local area into a plane, but the errors are much smaller than the magnitudes of the distances involved between locomotives, and the angular relationships between locomotives will remain correct. These errors are held to a minimum through simultaneous positioning of multiple assets.

A last step in the determination of the locomotive consist is determining the orientation of the locomotives in the consist with respect to short-hood forward versus long-hood forward. The data center determines the orientation by decoding the discrete data received from each locomotive. Trainlines eight (8) and nine (9) provide the direction of travel with respect to the crew cab on the locomotive. For example, a trailing locomotive traveling long-hood forward will report trainline nine (9) as energized (74 VDC), indicating the locomotive is long-hood forward. Likewise, a locomotive reporting trainline eight (8) energized (74 VDC) is assumed to be travelling short-hood forward. Utilizing the orientation of the locomotives, e.g., short hood forward (SHF) and long hood forward (LHF), railroad dispatchers are able to select a locomotive in a proper orientation to connect to a train or group of locomotives.

The above described method for determining locomotives in a locomotive consist is based on locomotives equipped with on-board tracking systems. Operationally, the presence of ghost locomotives in a locomotive consist will be very common. Even though a ghost locomotive cannot directly report through the data center, its presence is theoretically inferable provided that it is positioned between two locomotives equipped with tracking systems.

Figure 9:
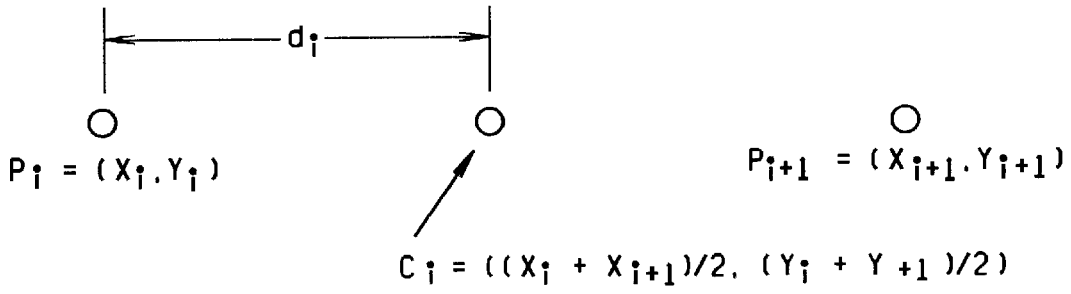
FIG. 9 illustrates location of a centroid between two locomotives.

To determine the presence of ghost locomotives between any two equipped locomotives, the order of all reporting locomotives in the locomotive consist is first determined. If there are N such locomotives at positions $P_1, P_2, \ldots, P_N$, the centroid $C_i$ of each adjacent pair of locomotives $P_1, P_{i+1}$, is determined as depicted in FIG. 9, for i=1, . . . , N−1. Then, the distance $d_1$ between the centroid $C_i$ and the locomotive position $P_i$, for i=1, . . . , N−1, is determined. The number $N_G$ of ghost locomotives in the power consist is equal to:

$$N_G=2\sum_{i=1}^{N-1}\left(\frac{d_i}{L}-0.5\right),$$

where L is a nominal length for a locomotive. In effect, the centroid between two consecutive locomotives with on-board systems should be approximately half a locomotive length from either of the locomotives, and that distance will expand by a half-locomotive length for each interposed ghost locomotive.

In an alternative embodiment, the invention determines the location, orientation, and order of barges in a barge consist on a river, or any other vehicles in a vehicle consist. The aforementioned functions and applications of the invention are exemplary only. Other functions and applications are possible and can be utilized in connection with practicing the invention herein.

Although the invention has been described and illustrated in detail, it is to be clearly understood that the same is intended by way of illustration and example only and is not to be taken by way of limitation. Accordingly the spirit and scope of the invention are to be limited only by the terms of the appended claims and their equivalents.

What is claimed is:

1. A method for determining an order and orientation of locomotives within a locomotive consist using a system including, at least one on-board tracking system, at least one first satellite, and a data center, the locomotive consist including at least one locomotive, each said tracking system mounted to a respective locomotive in the consist, each locomotive including at least one sub-system related to the operation of the respective locomotive, said method comprising the steps of:

simultaneously transmitting from the at least one first satellite to each tracking system a set of locomotive location coordinates (LLC) identifying a location of the respective locomotive;

transmitting a data message to the data center;

determining which locomotive in the consist is a lead locomotive;

determining which locomotives in the consist are trailing locomotives;

determining the orientation of each trailing locomotives; and determining the order of the trailing locomotives in the consist.

2. A method in accordance with claim 1 wherein the at least one onboard tracking system includes a computer, and the data center includes at least one processor and at least one data center antenna, said step of simultaneously transmitting further comprises the steps of:

repeating the simultaneous transmission at a specified and sample time; and transmitting from the at least one sub-system to the computer a set of locomotives descretes, the descretes including a reverser handle position indentifying the gear status of the respective locomotive, a trainlines eight (8) and nine (9) identifying the direction of travel of the respective locomotive, and an online/isolate switch position identifying the mode of the respective locomotive.

3. A method in accordance with claim 2 wherein each onboard tracking system also includes a locomotive interface, a position sensor, a communicator, a transceiver connected to the communicator, and a position antenna connected to the position sensor, said method further comprising the steps of:

interfacing between the locomotive interface and the at least one sub-system of the respective locomotive;

transmitting inputs from the locomotive interface to the computer;

exchanging communications between the position sensor and the computer;

exchanging communications between the communicator and the computer;

exchanging communications between the transceiver and the data center; and exchanging signals between the position antenna and the at least one first satellite.

4. A method in accordance with claim 3 wherein the system further includes at least one second satellite and the transceiver includes a satellite transceiver, said method further including the steps of:

exchanging communications between the at least one second satellite and the at least one on-board tracking system utilizing the satellite transceiver; and exchanging communications between the at least one second satellite and the data center utilizing the at least one data center antenna.

5. A method in accordance with claim 4 wherein said step of transmitting a data message to the data center further comprises the steps of:

transmitting the set of LLC from each on-board tracking system to the data center using the at least one second satellite; and transmitting the discretes from each tracking system to the data center using the at least one second satellite.

6. A method in accordance with claim 5 wherein said step of determining which locomotive in the consist is the lead locomotive further comprises the steps of:

analyzing the data message using the data center; and utilizing the discretes to determine which locomotive in the consist is a lead locomotive.

7. A method in accordance with claim 6 wherein said step of determining which locomotives in the consist are trailing locomotives further comprises the steps of:

analyzing the data message using the data center; and utilizing the discretes and the set of LLC to determine which locomotives in the consist are trailing locomotives.

8. A method in accordance with claim 7 wherein said step of determining the orientation of each trailing locomotive further comprises the steps of:

analyzing the data message using the data center; and utilizing the trainlines eight (8) and nine (9) to identify the direction of travel of each trailing locomotive.

9. A method in accordance with claim 8 wherein said step of determining the order of the trailing locomotives further comprises the steps of:

analyzing the data message using the data center; and utilizing the set of LLC to determine a positional relationship between each locomotive in the consist according to equations $$\angle P_i P_j P_1 \approx 180° \rightarrow P_i \text{ follows } P_j,$$

and $$\phi P_i P_j P_1 \approx 0° \rightarrow P_i \text{ precedes } P_j$$

where $P_1$ is the location of the lead locomotive, $P_i$ and $P_j$ are the locations of trailing locomotives.

10. A method in accordance with claim 9 wherein said step of determining the order of the trailing locomotives in the consist further comprises the steps of:

forming a matrix with all rows and columns indexed by all the locomotive in the consist; and executing the matrix using the determined positional relationship of the locomotives.

11. A method in accordance with claim 10 wherein said step of executing the matrix further comprises the steps of:

placing a (1) in any cell where, according to the determined positional relationships, the row entry is earlier in the consist than the column entry;

summing the total number of (1's) in each row; and determining the order of the trailing locomotives according to the number of (1's) in each row, such that the row entry with the most number of (1's) is the earliest trailing locomotive in the consist and the trailing locomotive row entry with the least number of (1's) is the last trailing locomotive in the consist.

12. A method in accordance with claim 3 wherein the system further includes a radio antenna and the transceiver includes a radio transceiver, said method further comprising the steps of:

exchanging communications between the radio antenna and the at least one on-board tracking system utilizing the radio transceiver; and exchanging communications between the radio antenna and the data center utilizing the at least one data center antenna.

13. A method in accordance with claim 12 wherein said step of transmitting a data message to the data center further comprises the steps of:

transmitting the set of LLC from each on-board tracking system to the data center utilizing the radio antenna; and transmitting the discretes from each tracking system to the data center utilizing the radio antenna and the at least one data center antenna.

14. A method in accordance with claim 3 wherein the system further includes at least one second satellite, one of the tracking systems is a hub on-board tracking system, and the transceiver includes a radio transceiver and a satellite transceiver, said method further comprising the steps of:

exchanging communications between the at least one second satellite and the at least one on-board tracking system utilizing the satellite transceiver;

exchanging communications between each of the at least one on-board systems and the hub on-board tracking system utilizing the radio transceiver;

exchanging communications between the hub on-board tracking system and the at least one second satellite utilizing the satellite transceiver; and exchanging communications between the at least one second satellite and the data center utilizing the at least one data center antenna.

15. A method in accordance with claim 14 wherein said step of transmitting a data message to the data center further comprises the steps of:

transmitting the set of LLC from each tracking system to the hub on-board tracking system using the radio transceiver;

transmitting the discretes from each tracking system to the hub on-board tracking system using the radio transceiver;

transmitting the sets of LLC from the hub on-board tracking systems to the data center using the at least one second satellite; and transmitting the discretes from the hub on-board tracking system to the data center using the at least one second satellite.

16. A method in accordance with claim 3 wherein the data center further includes a web server, said method further comprising the steps of:

enabling access to the data center using the Internet; and enabling a user to view a graphical representation of the order and orientation of each locomotive in the consist using the Internet and the web server.

17. A system for determining the order and orientation of locomotives within a locomotive consist, said system comprising:

a locomotive consist comprising at least one locomotive;

at least one on-board tracking system, each said tracking system mounted to a respective locomotive in said consist;

a first satellite configured to exchange communications with said at least one on-board tracking system; and a data center configured to determine a location of, an orientation of, and a positional relationship between each said locomotive in said consist.

18. A system in accordance with claim 17 wherein said first satellite is a Global Positioning System (GPS) satellite.

19. A system in accordance with claim 17 wherein each said locomotive in said consist comprises at least one sub-system related to the operation of the respective locomotive, each said tracking system comprises:

a locomotive interface configured to interface with said at least one sub-system of a respective locomotive;

a computer configured to receive inputs from said interface and execute all functions of a respective said tracking system;

a position sensor configured to exchange communications with said first satellite and to exchange communications with said computer;

a communicator configured to exchange communications with said computer;

a transceiver connected to said communicator configured to exchange communications with said data center; and a position antenna connected to said position sensor configured to exchange signals with said at least one first satellite.

20. A system in accordance with claim 19 wherein said at least one first satellite further configured to simultaneously transmit to each said tracking system a set of locomotive location coordinates (LLC) identifying a location of said respective locomotive, the simultaneous transmissions repeated at a specified send and sample time.

21. A system in accordance with claim 19 wherein said locomotive interface further configured to receive a set of locomotive discretes from said at least one sub-system, said discretes including:

a reverser handle position for identifying a gear status of said respective locomotive;

a trainlines eight (8) and nine (9) for identifying a direction of travel of said respective locomotive; and an online/isolate switch position for identifying a mode of said respective locomotive.

22. A system in accordance with claim 21 wherein said data center comprises at least one processor and at least one data center antenna.

23. A system in accordance with claim 21 wherein said transceiver comprises a satellite transceiver.

24. A system in accordance with claim 23 further comprising at least one second satellite configured to exchange communications with said tracking system using said satellite transceiver, said at least one second satellite further configured to exchange communications with said data center utilizing said at least one data center antenna.

25. A system in accordance with claim 24 wherein each said tracking system further configured to transmit a data message comprising the set of LLC and the set of discretes to said data center using said second satellite.

26. A system in accordance with claim 25 wherein said data center is further configured to analyze the data message and determine which locomotive in said consist is a lead locomotive based on the set of discretes.

27. A system in accordance with claim 25 wherein said data center further configured to analyze the data message and determine which locomotives in said consist are a trailing locomotive based on the set of discretes and the set of LLC, said data center further configured to determine the orientation of each trailing locomotive based on the trainlines eight (8) and nine (9).

28. A system in accordance with claim 17 wherein said data center further configured to use said set of LLC for each locomotive in said consist to determine a positional relationship between each locomotive in said consist according to the equations $$\angle P_i P_j P_1 \approx 180° \rightarrow P_i \text{ follows } P_j,$$

and $$\angle P_i P_j P_1 \approx 0° \rightarrow P_i \text{ precedes } P_j$$

where $P_1$ is the location of the lead locomotive, $P_i$ and $P_j$ are the locations of trailing locomotives.

29. A system in accordance with claim 17 wherein said data center is further configured to determined an order of trailing locomotives in said consist by forming a matrix with all rows and columns indexed by all the locomotives in said consist and using the determined positional relationships of the locomotives to execute said matrix by placing a (1) in any cell where the row entry is earlier in said consist than the column entry, the order of trailing locomotives being determined according to the number of (1's) in each row, the trailing locomotive row entry with the most (1's) being the earliest trailing locomotive in said consist and the trailing locomotive row entry with the least (1's) being the last trailing locomotive in said consist.

30. A system in accordance with claim 22 wherein said transceiver comprises a radio transceiver.

31. A system in accordance with claim 30 wherein said system further comprises a radio antenna configured to exchange communications with said tracking system using said radio transceiver, said radio antenna further configured to exchange communications with said data center utilizing said at least one data center antenna.

32. A system in accordance with claim 31 wherein said tracking system further configured to transmit a data message comprising the set of LLC and the set of discretes to said data center using said radio antenna.

33. A system in accordance with claim 22 further comprising a second satellite, one of said at least one on-board tracking systems comprising a hub on-board tracking system.

34. A system in accordance with claim 33 wherein said transceiver comprises a satellite transceiver and a radio transceiver, said satellite transceiver configured to exchange communications with said second satellite, said radio transceiver configured to exchange communications between said hub on-board tracking system and each of the other of said at least one on-board tracking system.

35. A system in accordance with claim 34 wherein each of said at least one on-board tracking systems further configured to transmit a data message comprising the set of LLC and the set of discretes to said hub on-board tracking system, said hub on-board tracking system further configured to compile a comprehensive data message comprising the data messages from each said tracking system, said hub on-board tracking system further configured to transmit the comprehensive data message to said data center using said second satellite.

36. A system in accordance with claim 22 wherein said data center further comprises a web server configured to enable a user to access said data center using the Internet, said web server further configured to enable a user to view a graphical representation of an order and orientation of the locomotives in said consist.

37. A system for determining the order and orientation of vehicles within vehicle consist, said system comprising:

a vehicle consist comprising at least one vehicle;

at least one one-board tracking system, each said tracking system mounted to a respective vehicle in said consist;

at least one first satellite configured to exchange communications with said at least one on-board tracking system; and a data center configured to determine the location of and orientation of each of vehicle in said consist and a positional relationship between each vehicle in said consist.

38. A system in accordance with claim 37 wherein said at least one first satellite is a Global Positioning System (GPS) satellite.

39. A system in accordance with claim 37 wherein each said vehicle comprises at least one sub-system related to operation of a respective said vehicle, each said tracking system comprises:

a vehicle interface configured to interface with said at least one sub-system;

a computer configured to receive inputs from said interface and execute all functions of said respective tracking system;

a position sensor configured to exchange communications with said at least one first satellite and to exchange communications with said computer;

a communicator configured to exchange communications with said computer;

a transceiver connected to said communicator configured to exchange communications with said data center; and a position antenna connected to said position sensor configured to exchange signals with said at least one first satellite.

40. A system in accordance with claim 39 wherein said at least one first satellite further configured to simultaneously transmit to each of said at least one on-board tracking systems a set of vehicle location coordinates (LLC) identifying a location of the respective vehicle, the simultaneous transmissions are repeated at a specified send and sample time.

41. A system in accordance with claim 40 wherein said vehicle interface further configured to receive a set of vehicle discretes from said at least one sub-system, the discretes including:

a reverser handle position for identifying a gear status of the respective vehicle;

a vehiclelines eight (8) and nine (9) for identifying a direction of travel of the respective vehicle; and an online/isolate switch position for identifying a mode of the respective vehicle.

42. A system in accordance with claim 41 wherein said data center comprises at least one processor and at least one data center antenna.

43. A system in accordance with claim 42 wherein said transceiver comprises a satellite transceiver.

44. A system in accordance with claim 43 further comprising at least one second satellite configured to exchange communications with said at least one on-board tracking system using said satellite transceiver, said at least one second satellite further configured to exchange communications with said data center utilizing said at least one data center antenna.

45. A system in accordance with claim 44 wherein each said tracking system further configured to transmit a data message comprising the set of LLC and the set of discretes to said data center using said at least one second satellite.

46. A system in accordance with claim 45 wherein said data center is further configured to analyze the data message and determine which vehicle in said consist is a lead vehicle based on the set of discretes.

47. A system in accordance with claim 46 wherein said data center is further configured to analyze the data message and determine which vehicles in said consist are trailing vehicles based on the set of discretes and the set of LLC, said data center further configured to determine an orientation of each trailing vehicle based on the vehiclelines eight (8) and nine (9).

48. A system in accordance with claim 47 wherein said data center is further configured to use the set of LLC for each vehicle in said consist to determine a positional relationship between each vehicle in said consist according to the equations $$<P_iP_jP_1 \approx 180° \rightarrow P_i \text{ follows } P_j,$$

and $$<P_iP_jP_1 \approx 0° \rightarrow P_i \text{ precedes } P_j$$

where $P_1$ is the location of the lead vehicle, $P_i$ and $P_j$ are the locations of trailing vehicles.

49. A system in accordance with claim 48, wherein said data center is further configured to determine the order of the trailing vehicles in said consist by forming a matrix with all rows and columns indexed by all the vehicles in said consist and using the determine positional relationships of the vehicles to execute said matrix by placing a (1) in any cell where the row entry is earlier in said consist than the column entry, the order of trailing vehicles being determined according to the number of (1's) in each row, the trailing vehicle row entry with the most (1's) being the earlies trailing vehicle in said consist and the trailing vehicle row entry with the least (1's) being the last trailing vehicle in said consist.

50. A system in accordance with claim 42 wherein said transceiver comprises a radio transceiver.

51. A system in accordance with claim 50 wherein said system further comprising a radio antenna configured to exchange communications with said at least one on-board tracking system using said radio transceiver and said radio antenna further configured to exchange communications with said data center antenna utilizing said data center antenna.

52. A system in accordance with claim 51 wherein each said tracking system further configured to transmit a data message comprising the set of LLC and the set of discretes to said data center using said radio antenna.

53. A system in accordance with claim 42 further comprising at least one second satellite, one said tracking system comprising a hub on-board tracking system.

54. A system in accordance with claim 53 wherein said transceiver comprises a satellite transceiver and a radio transceiver, said satellite transceiver configured to exchange communications with said at least one second satellite, said radio transceiver configured to exchange communications between said hub on-board tracking system and another of said tracking systems.

55. A system in accordance with claim 54 wherein each said tracking system further configured to transmit a data message comprising said set of LLC and said set of discretes to said hub on-board tracking system, said hub on-board tracking system further configured to compile a comprehensive data message comprising the data messages from each said tracking system, said hub on-board tracking system further configured to transmit said comprehensive data message to said data center using said at least one second satellite.

56. A system in accordance with claim 42 wherein said data center further comprises a web server configured to enable a user to access said data center using the Internet, said web server further configured to enable a user to view a graphical representation of order and orientation of vehicles in said consist.

* * * * *

UNITED STATES PATENT AND TRADEMARK OFFICE

CERTIFICATE OF CORRECTION

PATENT NO. : 6,421,587 B2 
DATED : July 16, 2002
INVENTOR(S) : David L. Diana et al.

It is certified that error appears in the above-identified patent and that said Letters Patent is hereby corrected as shown below:

Column 10,
Line 52, delete "orientation of each trailing locomotives;" insert therefor -- orientation of each trailing locomotive; --.
Line 61, delete "specified and" insert therefor -- specified send and --.

Column 12,
Second equation, delete "Φ" insert therefor -- < --.
Line 11, delete "all the locomotive" insert therefor -- all the locomotives --.

Column 16,
Line 60, delete "determine" insert therefor -- determined --.
Line 65, delete "earlies" insert therefor -- earliest --.

Signed and Sealed this

Eighteenth Day of November, 2003

JAMES E. ROGAN
*Director of the United States Patent and Trademark Office*